United States Patent [19]

Feagin, Jr.

[11] Patent Number: 4,493,494

[45] Date of Patent: Jan. 15, 1985

[54] SKI POLE HANDLE

[76] Inventor: John A. Feagin, Jr., P.O. Box 2770, Jackson, Wyo. 83001

[21] Appl. No.: 399,269

[22] Filed: Jul. 19, 1982

[51] Int. Cl.[3] ..... A63C 11/22

[52] U.S. Cl. ..... 280/821; 135/76

[58] Field of Search ..... 280/821; D8/DIG. 6; 2/17; 135/76; 272/68

[56] References Cited

U.S. PATENT DOCUMENTS

| | | | |
|---|---|---|---|
| 3,879,048 | 4/1975 | Penney | 280/821 |
| 4,004,818 | 1/1977 | Ramillon | 280/821 |
| 4,037,850 | 7/1977 | Haberlin | 280/821 |

*Primary Examiner*—Joseph F. Peters, Jr.
*Assistant Examiner*—Joseph G. McCarthy
*Attorney, Agent, or Firm*—Philip M. Shaw, Jr.

[57] ABSTRACT

A ski pole handle having both a finger shield and a thumb shield for restraining the thumb against backward movement relative to the fingers.

6 Claims, 3 Drawing Figures

SKI POLE HANDLE

BACKGROUND OF THE INVENTION

This invention relates to ski pole handles and more particularly to an improved ski pole handle with finger guards.

In recent years ski pole handles of the type which involved a palm grip together with a wrist strap are gradually being replaced by a unitary ski pole handle of the type which has a palm grip together with an outer hook portion which curves over the backside of the hand. The purpose of the hook portion, in addition to performing some guarding of the back of the hand, is primarily for the purpose of acting as a hook to hold the handle on the hand when the palm and fingers are flexed open. In this sense the portion that curves over the back of the hand replaces the function of the wrist strap on the older model ski pole handles. One disadvantage common to both versions of ski pole handles is that there is no protection offered to the thumb of the user.

As a consequence, when a skier falls using such handles, if often happens that the skier's hand flexes open and causes the thumb to project outwardly. The thumb can then engage in the snow and be bent backwards, either dislocating the thumb or causing a fracture of one of the carpals, the metacarpal or a dislocation of any of the joints between the metacarpal, the carpals or the radiocarpal joint. Since it is an unnatural tendency to fall with a closed fist, the skier is unlikely to be able to protect him or herself from such injury.

SUMMARY OF THE INVENTION

The above problems of prior art ski pole handles are overcome by the present invention of a ski pole hand grip comprised of an elongated palm and finger grip which is generally oval in cross-section and which has, in addion to a generally annular, web shaped knuckle shield, a generally annular, web shaped thumb shield which is integrally attached to the top of the hand grip. In the preferred embodiment of the invention, the top of the grip is also provided with a recess for receiving the fascial space of the thumb pad. The preferred embodiment also is provided with a longitudinal groove for receiving the heel of the palm. The knuckle shield and the thumb shield are, in the preferred embodiment, both bifurcated to allow the shields to flex outwardly to release the hand in the event that the pole is pulled away from the skier. Furthermore, in the preferred embodiment, the top of the grip is also provided with a ridge for engaging the fold of the knuckle of the thumb at the metacarpophalangeal joint.

It is therefore an object of the present invention to provide an improved ski pole handle which protects the thumb from injury.

It is still another object of the invention to provide a ski pole handle which restrains the hand of the user into a closed position of the thumb relative to the other fingers of the hand.

The novel features which are believed to be characteristic of the invention, both as to organization and method of operation, together with further advantages thereof, will be better understood from the following drawings, in which several preferred embodiments of the invention are illustrated by way of example.

DETAILED DESCRIPTION OF THE PREFERRED EMBODIMENT

Figure 1A:
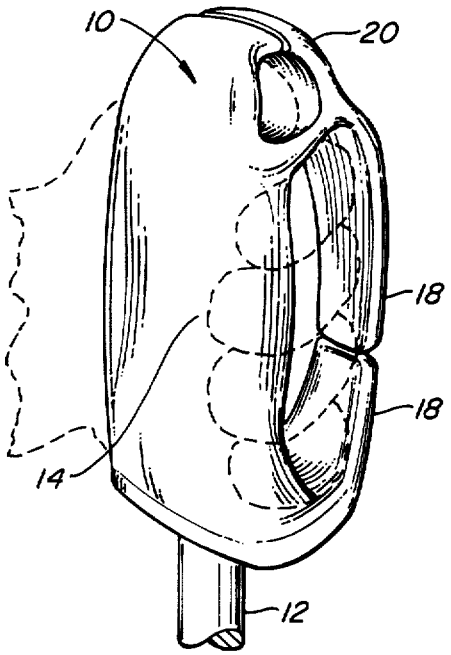
FIGS. 1A and 1B are perspective views, illustrating the ski pole handle of the invention together with a skier's hand in dashed line.
Figure 1B:
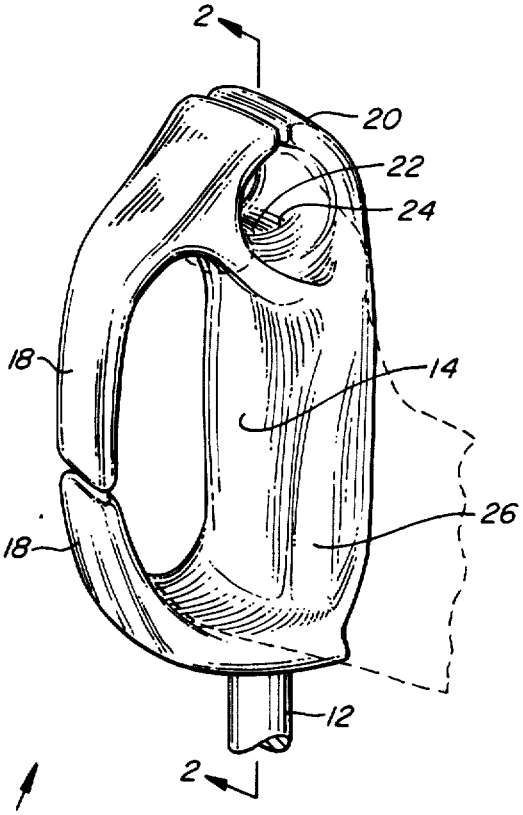
Figure 2:
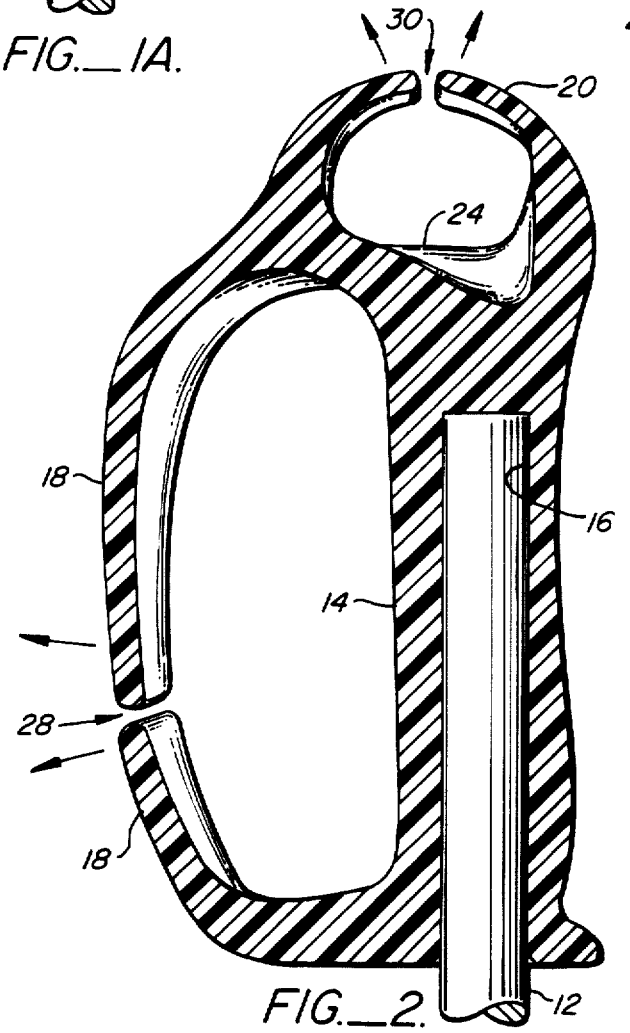
FIG. 2 is an enlarged vertical, sectional view, taken generally along the lines 2—2 of FIG. 1B.

Referring now to the figures, a hand grip 10 for a ski pole 12 is illustrated. The hand grip is comprised of an elongated palm and finger grip portion 14 which is generally oval in cross-section, taken perpendicular to the longitudinal axis of the ski pole. The grip 14 is provided with a longitudinal recess 16 for receiving one end of the ski pole 12. A generally annular, web shaped finger knuckle shield 18 is integrally attached to the grip 14 at its top and bottom.

A generally annular, web shaped thumb shield 20 is integrally attached to the top of the grip 14. The width of the shield is such that it substantially covers the user-'entire thumb. The top of the grip 14 is provided with a recess 22 for receiving the bulb of the skier's thumb. The top of the grip is also provided with a ridge 24 for engaging the fold of the thumb knuckle of the user. A vertical, longitudinal groove 26 in the hand grip 14 receives the skier's palm. In this way, the skier grips the hand grip portion 14 between the fingers and the palm and hooks his or her thumb knuckle over the ridge 24 into the recess 22 through the thumb shield 20.

The shields 18 and 20 are bifurcated at points 28 and 30 and are made of a yieldable material to allow the shields to flex outwardly in the event that the ski pole is pulled away from the hand of the user. This will allow the hand to not be entangled in the handle in such event. Contrary to prior art ski pole handles, the handle depicted in the figures restrains the user's thumb from flexing outwardly relative to the other fingers of the hand and, thus, prevents the thumb from being dislocated or broken by being buried in the snow or from being hit by a solid object such as a branch or a ski.

The terms and expressions which have been employed here are used in terms of description and not of limitation and there is no intention, in the use of such terms and expressions, of excluding equivalents of the features shown and described, or portions thereof, it being recognized that various modifications are possible within the scope of the invention as claimed.

What is claimed is:

1. A ski pole hand grip comprising an elongated palm and finger grip, generally oval in cross-section, having a top and a bottom and which has a longitudinal recess for receiving one end of a ski pole, a generally annular, web shaped, finger knuckle shield which is integrally attached to the grip and a generally annular, web shaped thumb shield integrally attached to the top of the grip and which encircles the thumb of the user whereby the finger knuckle shield and the thumb shield together restrain the relative angular positions of the thumb and fingers of a user to prevent the thumb from being bent back relative to the hand.

2. A ski pole hand grip as recited in claim 1 wherein the grip is provided with a vertically extending groove for receiving the heel of a palm.

3. A ski pole hand grip as recited in claim 1 wherein the finger knuckle shield is bifurcated cross-wise and is made of a yieldable material.

4. A ski pole hand grip as recited in claims 1 or 3 wherein the thumb shield is bifurcated cross-wise and is made of a yieldable material.

5. A ski pole handle as recited in claim 1 wherein the top of the grip is provided with a ridge for engaging the fold of the knuckle of a thumb.

6. A ski pole handle as recited in claims 1 or 3 wherein the finger knuckle shield is attached to the bottom of the grip.

* * * * *